United States Patent [19]

Doyle

[11] Patent Number: 4,741,281

[45] Date of Patent: May 3, 1988

[54] SAIL HANDLING SYSTEM

[75] Inventor: Robert E. Doyle, Marblehead, Mass.

[73] Assignee: Doyle Sailmakers, Inc., Marblehead, Mass.

[21] Appl. No.: 901,754

[22] Filed: Aug. 28, 1986

[51] Int. Cl.[4] ..... B63H 9/04

[52] U.S. Cl. ..... 114/102

[58] Field of Search ..... 114/97, 98, 39, 102–109, 114/113–115

[56] References Cited

U.S. PATENT DOCUMENTS

| | | | |
|---|---|---|---|
| 2,247,219 | 6/1941 | Childs | 114/104 |
| 2,251,512 | 8/1941 | Bush et al. | 156/33 |
| 2,724,356 | 11/1955 | Szakacs | 114/102 |
| 2,865,418 | 12/1958 | Bourdon | 150/1 |
| 3,147,729 | 9/1964 | Barnard | 114/108 |
| 3,157,149 | 11/1964 | Manchester | 114/104 |
| 4,094,351 | 6/1978 | Catenaccio | 150/7 |
| 4,122,793 | 10/1978 | Molz | 114/106 |
| 4,280,431 | 7/1981 | Sofen | 114/105 |
| 4,343,257 | 8/1982 | Stevenson | 114/104 |
| 4,347,799 | 9/1982 | Moriarty | 114/102 |
| 4,354,444 | 10/1982 | Puretic | 114/104 |
| 4,365,572 | 12/1982 | Stevenson | 114/104 |
| 4,469,040 | 9/1984 | Gougeon et al. | 114/104 |

*Primary Examiner*—Sherman D. Basinger
*Assistant Examiner*—Jésus D. Sotelo
*Attorney, Agent, or Firm*—Jeremiah Lynch

[57] ABSTRACT

A sail system in which the sail is reefed or furled by dropping and folding it progressively into a cover extending along the foot. The cover has starboard and port cover sides extending upwardly from the foot and joining cover lifters which are in turn attached to the sail. The cover sides have closure means along their upper edges for fastening them together after the sail and fly have been fully furled therewithin. Lazy jacks extend along each side of the sail and downwardly to the foot. One or more reef lines may each extend from the foot upwards through a cover side, through a reef cringle on the sail, and downwardly to a pulley attached at the clew.

11 Claims, 2 Drawing Sheets

FIG. 7
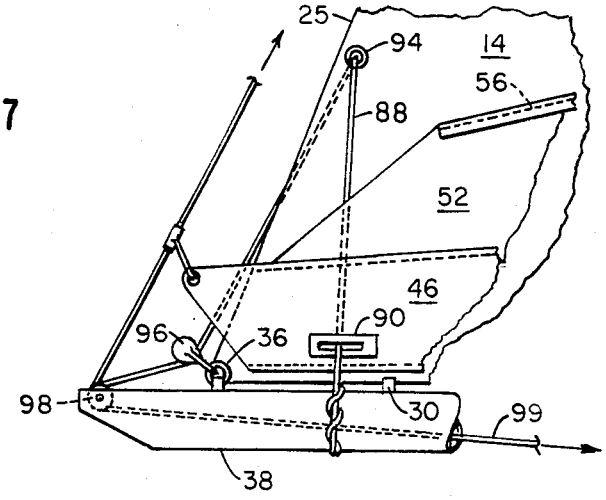
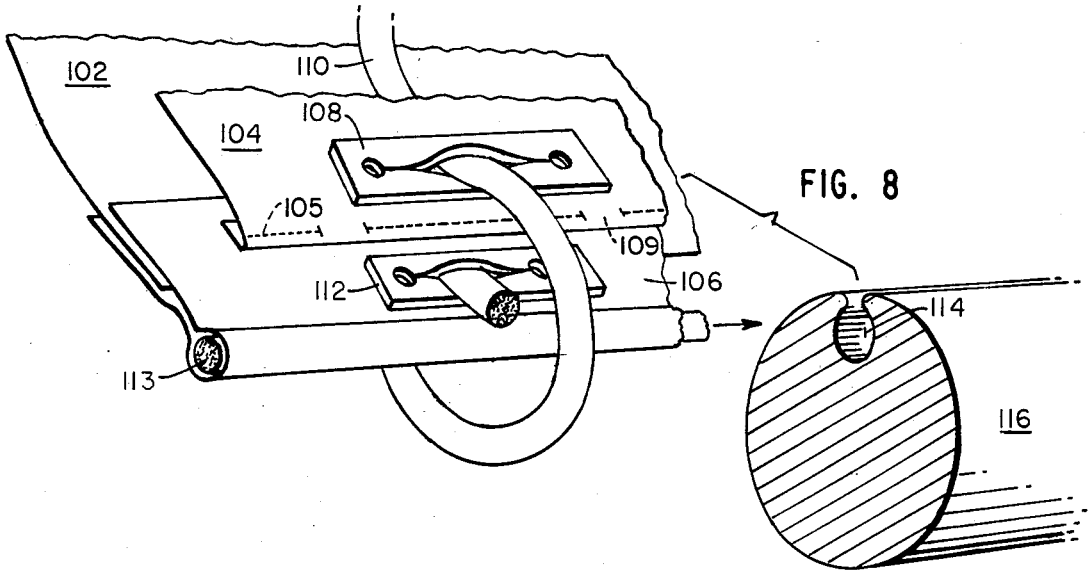
FIG. 8

SAIL HANDLING SYSTEM

BACKGROUND OF THE INVENTION

This invention relates generally to systems for handling sails, including reefing and furling. More particularly, it concerns self-contained systems suitable for use with sails having battens of any desired length extending from the leech part way or the full distance to the luff, providing controlled folding and furling of the sail with minimum labor.

Sail covers have been provided for sails furled to a boom to protect them from the weather and the damaging effects of ultraviolet light from the sun. Such covers are usually separate and must be attached to the boom when in use. These covers serve no function during the reefing or furling of the sail.

Sail covers have also been incorporated into the luff portion of sails, in which case the sail is furled against the mast progressively from top to foot. This requires the outhaul to be eased off and effectively prohibits the use of battens of any length.

It is a principal object of this invention to provide an improved sail handling system in which a sail cover is structurally combined with the sail in a non-interfering location while under way, but is adapted for readily receiving the furled or reefed parts of the sail when required.

A second object is to provide a system adapted for reefing and furling sails having full length battens, allowing the battened sail to drop into a cover without obstruction.

A third object is to provide means for controlling the furled sail as it drops into the cover, thereby allowing it to fold in a uniform, compact manner.

A fourth object is to provide a furling system that is readily adapted for sails with one or more reefs, allowing for the movement of reef lines without interference with other parts of the sail handling system.

Having in view the foregoing objects and others hereinafter appearing, the features of this invention include the provision of a self-contained, upright cover that extends substantially the length of the foot of the sail and accommodates a mainsail with full length battens. The cover comprises starboard and port cover sides that extend upwardly from the foot on the respective sides of the sail. The cover sides have closure means for fastening them together after the fully furled sail and fly have been lowered and folded within them. Lazy jacks of any one of several equivalent vertically extending forms extend along each side of the sail and downwardly to the foot. The lazy jack lines control the sail as it drops to cause it to fold neatly between the cover sides. One or more reef lines may each extend upwardly from the foot, through a reef cringle on the sail, and downwardly toward the clew of the sail to a reefing pulley.

DESCRIPTION OF THE DRAWING

FIG. 7 is a partial enlarged side elevation showing details of the reefing tackle.

FIG. 8 is an illustration showing details of the preferred construction where the foot of the sail is provided with a boltrope.

DETAILED DESCRIPTION

Figure 1:
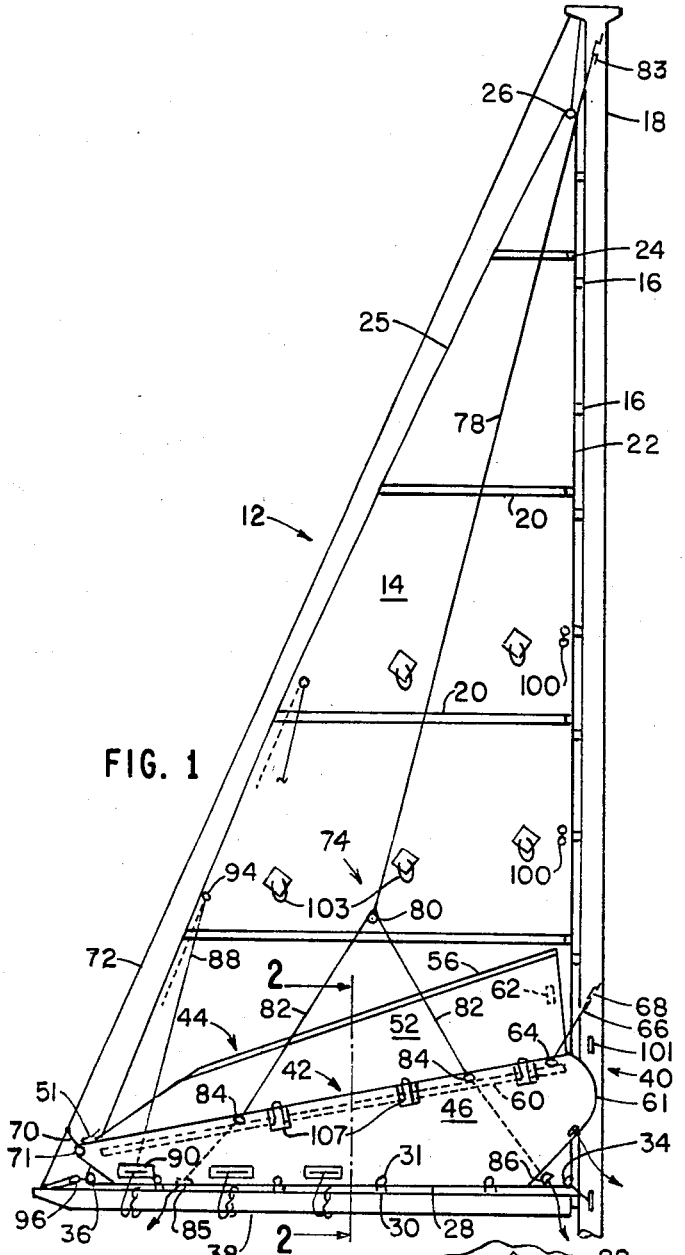
FIG. 1 is a side elevation of a mainsail system embodying the invention.
Figure 3:
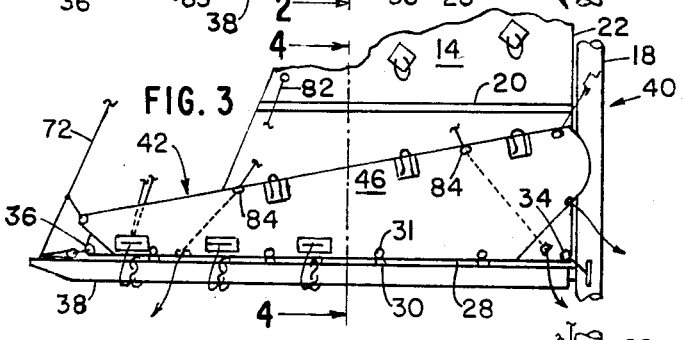
FIG. 3 is a partial elevation of the sail system of FIG. 1 in a partially furled position.

The invention is described herein as applied preferably to a triangular or Marconi-rigged mainsail, although it will be apparent that it may be applied, for example, to gaff mainsails and other sails carried on a boom, where appropriate, such as mizzen sails on yawls and ketches, and club jibs.

The sail system, designated generally at 12, includes a mainsail 14 provided with a plurality of conventional mast slides 16 for running up a mast 18. In the following description the parts of the sail are referred to using the standard nomenclature. Thus the three edges of the triangular sail 14 are the "luff"—the leading edge, the "leech"—the trailing edge, and the "foot"—the bottom edge. The three corners are the "head" at the top, the tack—the forward lower corner, and the "clew"—the after lower corner. The sail shown has a plurality of full length battens 20, that is, battens that each extend from leech to luff, which act as stiffeners and are of conventional construction. If desired, the battens may be omitted or may be of shorter length. The battens are preferably perpendicular to the luff and parallel to the foot. The sail may be concave or straight at the leech 25, or may have a convex curvature, called a "roach". In the illustration a small roach is shown. A leech cord (not shown) may slide in a tunnel on the edge of the leech, being fixed at one end or the other of the leech and adjustable to control flutter. As shown, the head is fitted with a head ring 26 for attachment to a halyard (not shown), in a conventional manner. Alternatively, the sail may be fitted with a conventional headboard.

The sail 14 extends downwardly to a foot 28. In the embodiment of FIGS. 1 to 6, foot slides 30 are attached to grommets 31 extending along the foot. If desired, the foot may be provided with a boltrope as shown in FIG. 8, either with or without foot slides, as hereinafter more fully described. Alternatively, in some cases the foot may be attached to the boom only at the tack and clew. The luff 22 is provided with a tape and may be reinforced with a bumper rope or extension of the boltrope in accordance with conventional practice. The sail also has conventional grommets or rings 34 and 36 at the tack and clew, respectively.

The boom 38 may take any conventional form, the one shown being hollow and having a track 37 for the slides 30. Conventional outhaul and downhaul tackle are used, but are omitted from the drawing for clarity of illustration.

The sail system 12 is provided with a cover designated generally at 40, comprising an outer part 42 and cover lifters 44. The outer part comprises a starboard cover side 46 and a port cover side 48. Along the full length and near the sloping top edge of each of these cover sides is attached a tape 50 of a slide fastener joinable with a similar tape along the other cover side by sliding a car 51 in a conventional manner. As an alternative to the slide fastener shown, other means of attachment may be employed, such as spaced buttons, snaps or hook and loop fasteners sold under the trademark "Velcro." When a slide fastener is used the car 51 remains at the clew end of the cover at all times, until after the sail has been fully lowered and folded into the cover, whereupon it is slid forwardly to close the cover either manually or by a line from the cockpit.

The cover lifters 44 comprise a starboard piece 52 and a port piece 54, these pieces being attached by sewing them to the top edges of the cover sides at points immediately below and inboard of the slide fastener tapes 50. The top edges of the pieces 52 and 54 are attached by sewing them to the sail 14 along a line 56 extending diagonally from a point near the luff 22 to a point near the leech 25 of the sail.

As shown, the cover lifters comprise a single piece of flexible fabric on each side of the sail. This provides the advantage of deflecting wind and rain from the interior of the cover sides. However, it will be apparent that one or more narrow strips or straps of line or webbing may be substituted for each of the pieces 52 and 54. These strips may each be sewn at one end to the sail and at the other end to the top of a cover side. Preferably, the strips are suitably spaced along the top of each cover side.

In some cases the cover lifters 44 may be omitted entirely. For example, buttons, snaps or hook and loop fastener parts may be attached to the top edge of each of the cover sides with matching fastener parts attached to the sail 14 in positions such that when the sail is fully raised, the button, snap or fastener parts on the cover and sail are engageable to hold the cover sides flush against the sail. For reefing or furling of the sail, these fasteners are manually separated.

Figure 2:
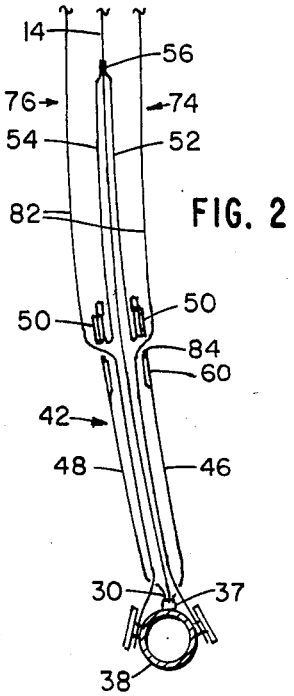
FIG. 2 is an elevation in section taken on line 2—2 of FIG. 1.
Figure 4:
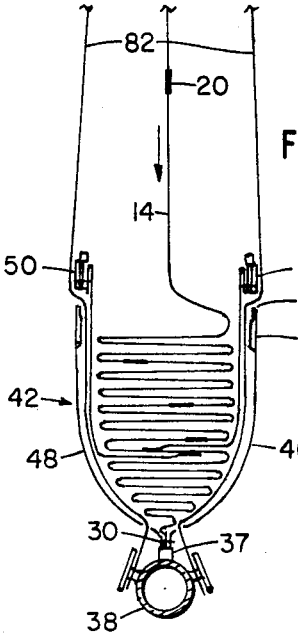
FIG. 4 is an elevation in section taken on line 4—4 of FIG. 3.

As shown in FIGS. 1 and 2, when the sail is fully raised the cover sides 46 and 48 and the pieces 52 and 54 of the lifters 44 lie substantially flat against the base portion of the sail 14. Thus, while under way the cover parts are secure and do not interfere with tacking or alter the sail configuration.

Preferably, the outer part 42 of the cover is constructed of acrylic fabric or any other suitable sheet material which protects the fully furled sail from deterioration by exposure to ultraviolet light. The sail is commonly fabricated of polyester fabric or other suitable material. On the other hand, the pieces 52 and 54 of the lifters 44 are constructed of a relatively lightweight fabric such as sailcloth.

As shown in FIG. 1 and FIGS. 2, 4 and 6, a cover batten 60 is inserted into a pocket near the top sloping edge of each of the starboard and port cover sides 46 and 48, and preferably extends nearly the full length of such edge, being preferably slightly longer than the longest sail batten 20.

The cover sides 46 and 48 may be provided at the luff end with a fore flap 61 or other suitable closure means (not shown) to be secured when the sail is furled. The edges of the pieces 52 and 54 of the lifters at the luff may have short pieces 62 of hook and loop fastener sewn to them, these pieces mutually engaging when the sail is in raised position to prevent wind from entering the cover and inflating it.

The general shape of the cover sides 46 and 48 is a quadrilateral, with a curved side at the tack end and obtuse and acute angles, respectively, at the lower and upper corners of the leech end, and with the luff end subtantially higher than the leech end. This shape is designed to provide a girth sufficient to accommodate the folds of the sail when it is fully furled. Grommets 64 (FIG. 1) are installed in the tack ends of the top edges of each of the cover sides adjacent the ends of the cover battens 60, for attaching supporting lines 66. Separate lines 66 on each of the cover sides 46 and 48 are attached to padeyes 68 screwed to the mast. At the clew end a supporting line 70 is secured to a grommet or grommets 71, or passes through a tape running through the leech end of the cover to the foot of the sail, and is attached to the topping lift 72. The supporting lines 66 and 70 hold the cover sides upright in the position illustrated.

The lowering or furling of the sail is facilitated by lazy jacks 74 and 76 respectively installed on the starboard and port sides of the sail 14. In the embodiment shown, each of the lazy jacks comprises an upper line 78 with a pulley or equivalent ring 80 attached at its bottom end, and a lower line 82 passing through the pulley or ring 80. As shown, the top end of the upper line 78 is tied to an upper eye strap 83 secured to the mast. Alternatively, it may be attached to the topping lift 72 or to a conventional spreader (not shown). Each lower line 82 has portions extending downwardly toward the foot 28 from the pulley or ring 80 and respectively in forward and aft oblique directions. These portions pass through grommets 84 located in the cover sides immediately below the fastener tapes 50. The ends nearer the clew are secured to grommets 85 within the cover sides at or adjacent the foot. The ends nearer the luff are secured to clam cleats 86 attached to the sail, these cleats being used for purposes of adjustment. As shown in FIG. 1, the lower lines 82 are bent by the grommets 84 in opposite directions so as to apply tension to the upper edges of the cover sides, thereby ensuring that the cover battens 60 will not buckle.

In some cases, in place of the upper line 78 and lower line 82, each of the lazy jacks 74 and 76 may comprise a single line attached at the upper end to the mast, to the topping lift or to a spreader, and at the lower end to the middle region of the cover. Also, whether upper and lower lines or only a single line is used, the lower end attachments may be to the top edges of the cover sides, rather than to the foot of the sail within the cover sides as shown.

From the foregoing description, it will be apparent that when the sail is lowered, the lazy jacks 74 function effectively to guide the falling sail 14 and battens 20 contained therein into the opening of the sail cover, and that the battens and lazy jacks have the combined effect of allowing the sail to fold into the cover in a uniform manner.

Figure 5:
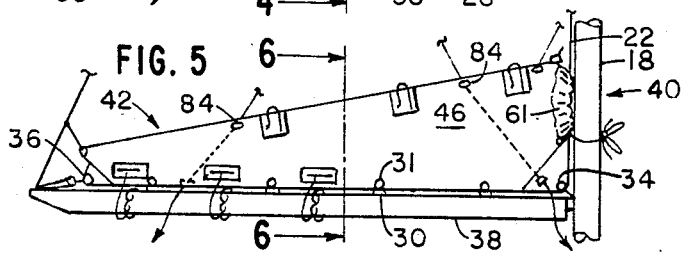
FIG. 5 is an elevation showing the sail system of FIG. 1 in fully furled position with the cover fully closed.
Figure 6:
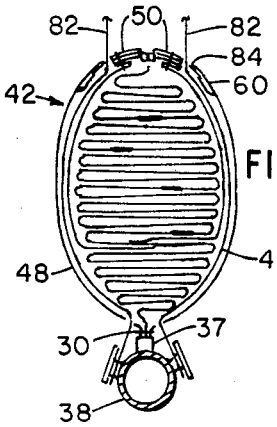
FIG. 6 is an elevation in section taken on line 6—6 of FIG. 5.

The furling and unfurling of the sail by means of the structure described above will be apparent from the drawing. The sail and cover parts when the head ring is raised to the masthead are as shown in FIGS. 1 and 2. When the sail is partially furled the parts take the configuration shown in FIGS. 3 and 4; and when the sail is fully furled the parts are as shown in FIGS. 5 and 6. Preferably, the closure tapes 50 are fully closed when the car 51 is located at the tack end.

As previously stated, the invention is readily adapted for use with sails having one or more reefs. Reefs are partially lowered sail positions used to reduce the functioning sail area in heavy winds, and entails the folding of the unused lower portion of the sail, as is well known in the art. As shown enlarged in FIG. 7, a reef line 88 is secured to the boom 38, passes upwardly into a cover side 46 through an elongate reef leather 90 adjacent the foot, continues through an opening between a cover lifter piece 52 and the sail behind the stitch line 56, passes through a reef ring or cringle 94, then passes downwardly through a pulley 96 attached to the clew grommet or ring 36, thence over a reef pulley 98 at the end of the boom 38. Other reef lines, instead of passing behind the stitch line 56, pass through leathers near the top edges of the lifter pieces to the corresponding reef rings. The remaining lengths 99 of the reef lines extend to conventional tackle. There are as many sheaves on the pulleys as there are reefs on the sail.

The construction of luff reefs is conventional and comprises reef O-rings or cringles 100 (FIG. 1) at spaced intervals along the luff for selective placement over a conventional reef horn 101 on the mast, for example.

Reef points 103 (FIG. 1) have cord loops, and corresponding reef hooks 107 are attached to the upper edges of the cover sides.

The invention is adapted for use with sails having foot slides only, boltropes only, boltropes and foot slides, or neither boltropes nor foot slides. In the last-mentioned case the outhaul develops sufficient tension to hold the foot of the sail taut when it is attached to the boom only at the tack and the clew. FIG. 8 illustrates a construction which may be used when boltropes only are used. A mainsail 102 has its foot secured along a stitch line 105 to a folded over cover side 104 so as to include a boltrope tape 106. The stitch line 105 is preferably discontinuous to provide weep holes 109 to drain out any rain water that may enter the cover. An elongate reef leather 108 is located above this stitch line to permit a reef line 110 to pass out of the cover side in a manner similar to that described with reference to FIG. 7. A second leather 112 is located on the boltrope tape below the stitch line 105 but sufficiently high that it will not interfere with the groove 114 in the boom 116 receiving the bumper rope 113. Thus the end of the reef line can be tied to the boom.

When foot slides are used with a boltrope grommets are located in the boltrope tape along the foot as needed for attachment of the foot slides, and a slide/slug is provided at the clew to support the reef pulley 96.

The mast slides 16 are preferably located so as to satisfy a number of conditions. The method of attachment is conventional, and such that the slides are able to twist readily to allow for easy flaking as the sail is reefed or furled. No slides are located on the portion of the sail 14 within the cover sides 46 and 48. The height of the cover sides at the luff end defines the minimum distance to the next mast slide above each reef. Preferably, there is a slide at or near each batten. The slides are spaced evenly between the battens above the top reef. The uppermost slide is located just below the head.

In the above-described embodiment, the lower lines 82 of the lazy jacks are described as passing through grommets 84 into the cover sides 46 and 48. This is the presently preferred structure, as it ensures that the sail will be guided into the cover as it is progressively furled. However, if means are provided so that the lower lines 82 are held in close enough proximity to the top edges of the cover when the latter is open, they may be entirely external to the cover sides. For example, the lower lines may be attached to the top edges of the cover sides as stated above, or they may pass through rings fastened to the outside of the cover sides in the approximate locations of the grommets 84, thence extending down to the foot externally of the cover sides.

The advantages of the invention will be apparent from the above description and apply to the several alternative embodiments as noted. In general, the handling of the sail while under way is substantially facilitated, particularly when sailing single-handed.

In particular, the invention is of great utility for sails equipped with battens, including battens of full length as illustrated, permitting their full use to control the shape of the sail and to increase airfoil performance in a manner which is now well understood in the art.

Additionally, the battens have utility during the lowering of the sail according to this invention, in that they give lateral stability to the sail, particularly when used in combination with the restraint of the lazy jacks. This is of particular advantage in heavy winds which tend to cause the sail to billow or flutter as it drops.

The lazy jacks function in one aspect to tend to limit the extent of the lateral excursion of the sail, as is well known. In another aspect, the lazy jacks give support to the cover sides to assist in holding them in an upright, open position. This support is furnished in one or more of several ways. First, in those cases where the lazy jacks are attached to the top edges of the cover sides they apply lifting forces directly to the latter. Second, in those cases where there are lower lines 82 as illustrated or equivalent forms with lines that extend downwardly in oblique directions through grommets such as 84, the cover sides are prevented from falling because of the increasing separation of the lines toward the foot. This is the case whether or not the lines are bent at the grommets 84 as illustrated, but the support of the cover sides is enhanced if the lines are so bent. Third, in cases where lazy jacks of any type including single lines extend through grommets in the upper parts of the cover sides, the lateral restraint of the grommets on the cover sides acts in conjunction with the stiffness of the latter to assist in holding them in an open upright position.

I claim:

1. A sail system comprising, in combination, a sail having a luff edge adapted for running up a mast and a foot, a cover extending substantially the length of the foot, being attached to the foot and including a cover side extending upwardly from the foot to a top edge on each side of the sail, and lazy jack means having portions extending adjacent and on both sides of the sail and tending to guide it into the cover sides upon furling.

2. A system according to claim 1, in which the lazy jack means extend downwardly into the cover sides.

3. A system according to claim 1, in which the lazy jack means extend downwardly to the foot.

4. A system according to claim 1, in which said portions comprise first and second lines, the first line having a top end with supports carried by the mast and a bottom end slidably engaging the second line, the second line having portions extending downwardly from said bottom end and respectively in forward and aft directions and being attached at the foot of the sail.

5. A system according to claim 4, in which said last-mentioned portions of the second line extend downwardly into the cover sides.

6. A system according to claim 5, including battens extending along the top edges of the cover sides, said second line of each lazy jack means passing through apertures in said cover sides spaced to maintain said battens under tension.

7. A sail system comprising, in combination, a sail having a luff edge adapted for running up a mast, a leech edge, a clew and a foot, a cover extending substantially the length of the foot, being attached to the foot and including a cover side extending upwardly from the foot to a top edge on each side of the sail, and a reef line adapted for attachment to said foot, extending upwardly into and through a said cover side, through a reef point on the sail, and downwardly adjacent the leech edge to the clew.

8. A sail system comprising, in combination, a sail having a luff edge adapted for running up a mast and a foot, a cover extending substantially the length of the foot, being attached to the foot and including a cover side extending upwardly from the foot to a top edge on each side of the sail, and cover lifters comprising flexible members on each side of the sail, said members each having a lower end portion attached to the top edge of a cover side and an upper end portion attached to the sail.

9. A system according to claim 8, in which the cover lifter on each side of the sail comprises a sheet of fabric.

10. A system according to claim 8, including closure means located at the top edges of the cover sides and adapted to fasten them together when the sail and cover lifters are furled therewithin, the lower portions of the cover lifters being attached to the cover sides inboard of the closure means.

11. A system according to claim 8, in which the cover lifters are attached to the sail at locations whereby the cover sides and lifters lie substantially against the sail when the sail is fully raised.

* * * * *